United States Patent [19]

Hawkins

[11] Patent Number: 4,935,752

[45] Date of Patent: Jun. 19, 1990

[54] THERMAL INK JET DEVICE WITH IMPROVED HEATING ELEMENTS

[75] Inventor: William G. Hawkins, Webster, N.Y.

[73] Assignee: Xerox Corporation, Stamford, Conn.

[21] Appl. No.: 330,574

[22] Filed: Mar. 30, 1989

[51] Int. Cl.[5] ..... B41J 2/05

[52] U.S. Cl. ..... 346/140 R; 338/333

[58] Field of Search ..... 346/140; 338/333

[56] References Cited

U.S. PATENT DOCUMENTS

| | | | |
|---|---|---|---|
| Re. 32,572 | 1/1988 | Hawkins et al. | 156/626 |
| 3,629,782 | 12/1971 | Sahni | 338/333 X |
| 4,339,762 | 7/1982 | Shirato et al. | 346/140 R |
| 4,370,668 | 1/1983 | Hara et al. | 346/140 R |
| 4,532,530 | 7/1985 | Hawkins | 346/140 R |
| 4,567,493 | 1/1986 | Ikeda et al. | 346/140 R |
| 4,686,544 | 8/1987 | Ikeda et al. | 346/140 R |
| 4,725,859 | 2/1988 | Shibata et al. | 346/140 R |
| 4,792,818 | 12/1988 | Eldridge | 346/140 |
| 4,831,391 | 5/1989 | Asai | 346/140 |

*Primary Examiner*—Joseph W. Hartary
*Attorney, Agent, or Firm*—Robert A. Chittum

[57] ABSTRACT

A thermal ink jet printhead is improved by using heating element structures which space the portion of the heating element structures subjected to the cavitational forces produced by the generation and collapsing of the droplet expelling bubbles from the upstream electrode interconnection to the heating element. In one embodiment this is accomplished by narrowing the resistive area where the momentary vapor bubbles are to be produced so that a lower temperature section is located between the bubble generating region and the electrode connecting point. In another embodiment, the electrode is attached to the bubble generating resistive layer through a doped polysilicon descender. A third embodiment spaces the bubble generating portion of the heating element from the upstream electrode interface, which is most susceptible to cavitational damage, by using a resistive layer having two different resistivities.

6 Claims, 4 Drawing Sheets

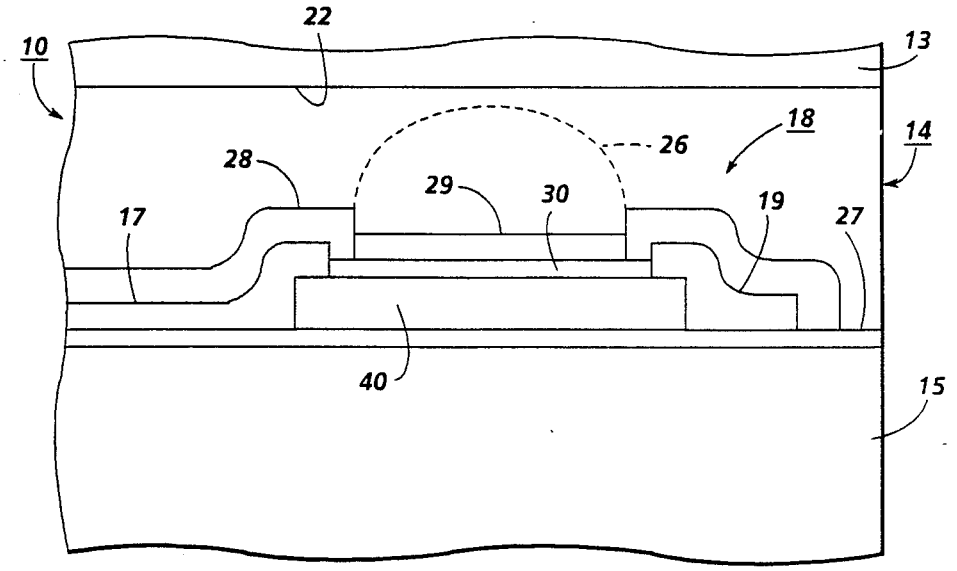
(PRIOR ART) FIG. 3
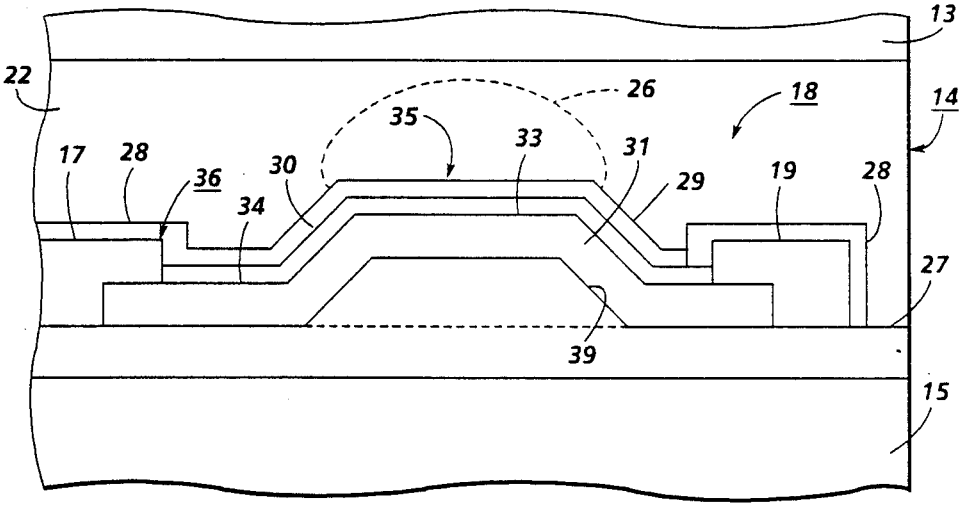
FIG. 4A
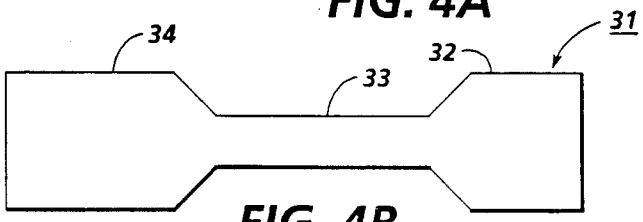
FIG. 4B

THERMAL INK JET DEVICE WITH IMPROVED HEATING ELEMENTS

BACKGROUND OF THE INVENTION

1. Field of the Invention

This invention relates to thermal ink jet printing devices and, more particularly, to thermal ink jet devices having improved bubble generating heating elements or transducers which prevent damage thereto caused by collapsing vapor bubbles, thus resulting in longer heating element lifetimes.

2. Description of the Prior Art

Though thermal ink jet printing may be either a continuous stream type or a drop-on-demand type of ink jet printing, its most common use is that of drop-on-demand. As a drop-on-demand type device, it uses thermal energy to produce a vapor bubble in an ink-filled channel to expel a droplet. A thermal energy generator or heating element, usually a resistor, is located in the channels near the nozzle a predetermined distance therefrom. The resistors are individually addressed with a current pulse to momentarily vaporize the ink and form a bubble which expels an ink droplet. As the bubble grows, the ink bulges from the nozzle and is contained by the surface tension of the ink as a meniscus. As the bubble begins to collapse, the ink still in the channel between the nozzle and bubble starts to move towards the collapsing bubble, causing a volumetric contraction of the ink at the nozzle and resulting in the separating of the bulging ink as a droplet. The acceleration of the ink out of the nozzle while the bubble is growing provides the momentum and velocity of the droplet in a substantially straight line direction towards a recording medium, such as paper.

The environment of the heating element during the droplet ejection operation consists of high temperatures, frequency related thermal stress, a large electrical field, and a significant cavitational stress. The mechanical stress, produced by the collapsing vapor bubble, in the passivation layer over the heating elements are severe enough to result in stress fracture and, in conjunction with ionic inks, erosion/corrosion attack of the passivation material. The cumulative damage and materials removal of the passivation layer and heating elements result in hot spot formation and heater failure.

Upon further investigation, it has been found that the bulk of all heating element failures occur not on the resistor which vaporizes the ink, but rather at the junction between the resistor and the addressing electrode connecting the resistor to its driver. In the side shooter configuration, where the flow direction of the ink to the nozzle and the trajectory of the expelled droplet are the same and this direction is parallel to the surface of the resistors, the electrode/resistor interface most vulnerable is on the upstream side of the resistor. The interface with the common return electrode which is nearer to the nozzle is less affected by cavitational forces.

When the thermal ink jet transducer is constructed with silicon integrated circuit fabrication methods, layers deposited prior to wafer metallization (typically aluminum or one of its alloys) can withstand high temperatures of around 1000° C. A straight forward consequence of high temperature processing is the ability to deposit or grow very low defect density, high quality dielectric films such as silicon dioxide or silicon nitride. It is relatively easy to deposit pinhole free dielectric films which are about 100 nm thick. Such thin, high quality dielectric films are ideal for transducer passivation because they have excellent electrical integrity while simultaneously having high thermal conductivity. On the other hand, dielectric films deposited following aluminum metallization are deposited at temperatures below 400° C., in order not to melt the aluminum, and are known for their relatively poor quality with respect to high temperature films.

The ink jet industry has recognized that the operating lifetime of the ink jet printhead is directly related to the number of cycles or bubbles generated and collapsed that the heating element can endure before failure. Various approaches and heating element constructions are disclosed in the following patents, though none heretofore have solved the primary vulnerability of the heating elements to failure because of the harsh environment of cavitational stress and erosion/corrosion attack by ionic inks.

U.S. Pat. No. 4,725,859 to Shibata et al discloses an ink jet recording head which comprises an electro-thermal transducer having a heat generating resistance layer and a pair of electrodes connected to the layer, so that a heat generating section is provided between the electrodes. The electrodes are formed thinner in the vicinity of the heat generating section for the purpose of eliminating a thinning of the passivation layer at the corners of the step produced by the confronting edges of the electrodes adjacent the heat generating section of the resistance layer.

U.S. Pat. No. 4,567,493 and U.S. Pat. No. 4,686,544, both to Ikeda et al disclose an ink jet recording head having an electro-thermal transducer comprising a pair of electrodes connected to a resistance layer to define a heat generating region. U.S. Pat. No. 4,567,493 discloses a passivation layer 208 that prevents shorting of electrodes, and a second passivation layer 209 prevents ink penetration and enhances liquid resistivity of the electrode passivation layers. Third layer 210 protects the heat generation region against cavitational forces. U.S. Pat. No. 4,686,544 discloses a common return electrode that covers the entire surface of the substrate 206 and overlying insulative layer 207 containing the plurality of transducers with openings therein for the placement of the heat generating regions.

U.S. Pat. No. 4,339,762 to Shirato et al discloses an ink jet recording head wherein the heat generating portion of the transducer has a structure such that the degree of heat supplied is different from position to position on the heating surface for the purpose of changing the volume of the momentarily produced bubbles to achieve gradation in printed information.

U.S. Pat. No. 4,370,668 to Hara et al discloses an ink jet recording process which uses an electro-thermal transducer having a structure laminated on a substrate including a resistive layer and addressing electrodes. A signal voltage is applied to the resistive layer while a second voltage of about half the signal voltage is applied to a tantalum protective layer electrically isolated from the transducer by a passivation layer. Such an arrangement elevates the dielectric breakdown voltage and increases the recording head lifetime.

U.S. Pat. No. 4,532,530 to Hawkins discloses a thermal ink jet printhead having heating elements produced from doped polycrystalline silicon. Glass mesas thermally isolate the active portion of the heating element from the silicon supporting substrate and from electrode connecting points.

SUMMARY OF THE INVENTION

It is the object of the present invention to provide a thermal ink jet printhead having heating elements with longer operating lifetimes.

It is another object of the invention to provide a thermal ink jet printhead having heating elements with a structure which spaces the bubble generating and collapsing area thereof from the addressing electrode interfaces.

It is still another object of the invention to minimize the amount of electrical energy required to eject an ink droplet, while simultaneously achieving longer operating lifetime.

In the present invention, a thermal ink jet printhead is improved by using heating element structures which space the portion of the heating element structures subjected to the cavitational forces produced by the generation and collapsing of the droplet expelling bubbles from the upstream aluminum electrode interconnection to the heating element. In one embodiment this is accomplished by narrowing the resistive area where the momentary vapor bubbles are to be produced, so that a lower temperature section is located between the bubble generating region and the electrode connecting point. In another embodiment, the electrode is attached to the bubble generating resistive layer through a doped polysilicon descender. A third embodiment spaces the bubble generating portion of the heating element from the upstream electrode interface, which is most susceptible to cavitational damage, by using a resistive layer having two different resistivies.

A more complete understanding of the present invention can be obtained by considering the following detailed description in conjunction with the accompanying drawings wherein like parts have the same index numerals.

BRIEF DESCRIPTION OF THE DRAWINGS

FIG. 3 is an enlarged, cross-sectional view of a prior art heating element in the same orientation as shown in FIG. 2.

FIG. 4A is an enlarged, cross-sectional view of the improved heating element shown in FIG. 2 and similar to the view in FIG. 3 for comparison therewith.

FIG. 4B is a plan view of the resistive layer of the heating element of FIG. 4A.

DESCRIPTION OF THE PREFERRED EMBODIMENT

Figure 1:
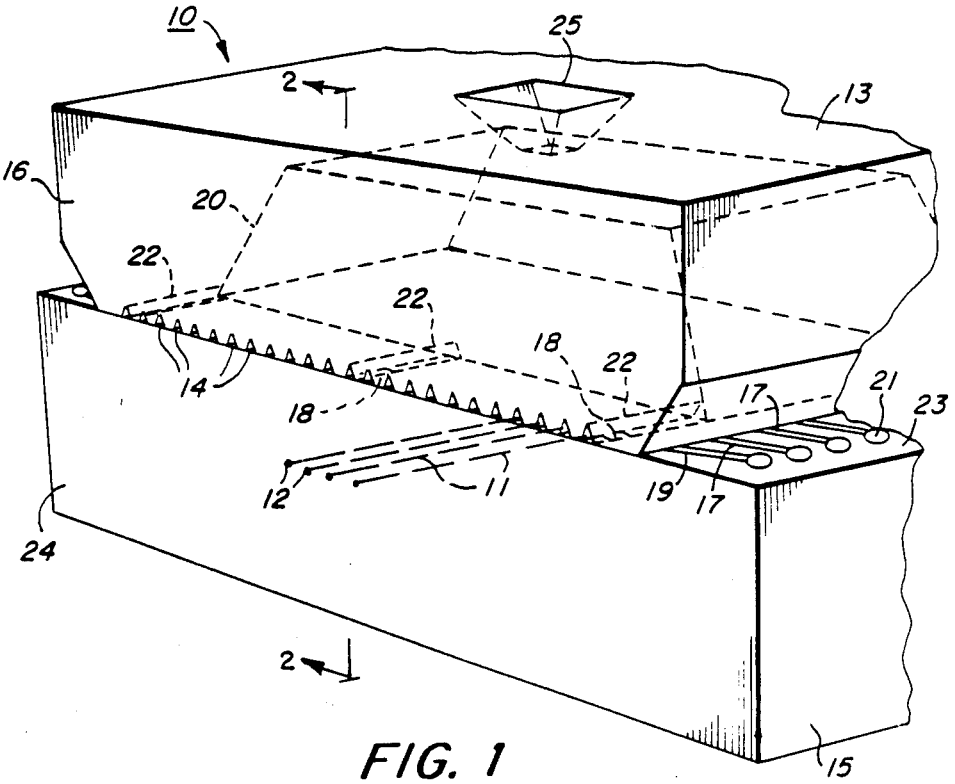
FIG. 1 is a schematic, partial isometric view of a typical printhead containing the improved heating elements of the present invention.

In FIG. 1, a schematic representation of a thermal ink jet printhead 10 containing the improved heating elements 18 of the present invention is partially shown in isometric view with the ink droplet trajectories 11 shown in dashed line for droplets 12 emitted from orifices or nozzles 14 on demand. The printhead comprises a channel plate or substrate 13 permanently bonded to heater plate or substrate 15. The material of the channel plate is silicon and the heater plate 15 may be any dielectric or semiconductive material. Alternatively, the channel plate can be a structure applied directly to the heater plate by thick film photosensitive material processes or other approaches well known in the ink jet industry. If a semiconductive material is used for the heater plate, then an insulative layer must be used between the electrodes 17 and 19 discussed later. Preferably, the material of both substrates is silicon because of their low cost, bulk manufacturing capability as disclosed in U.S. Pat. Re. No. 32,572 to Hawkins and incorporated herein by reference.

Channel plate 13 contains an etched recess 20, shown in dashed lines, in one surface which, when mated to the heater plate 15 forms an ink reservoir or manifold. A plurality of identical parallel grooves 22, shown in dashed lines and having triangular cross sections, are etched in the same surface of the channel plate with one of the ends thereof penetrating edge 16 of the channel plate. The other ends of the grooves open into the recess or manifold 20. When the channel plate and heater plate are mated, the groove penetrations through edge 16 produce the orifices 14 and the grooves 22 serve as ink channels which connect the manifold with the orifices. Opening 25 in the channel plate provides means for maintaining a supply of ink in the manifold from an ink supply source (not shown). Alternatively, the manifold 20 may be produced by a through etch (not shown) where the open bottom would serve as the ink inlet.

Figure 2:
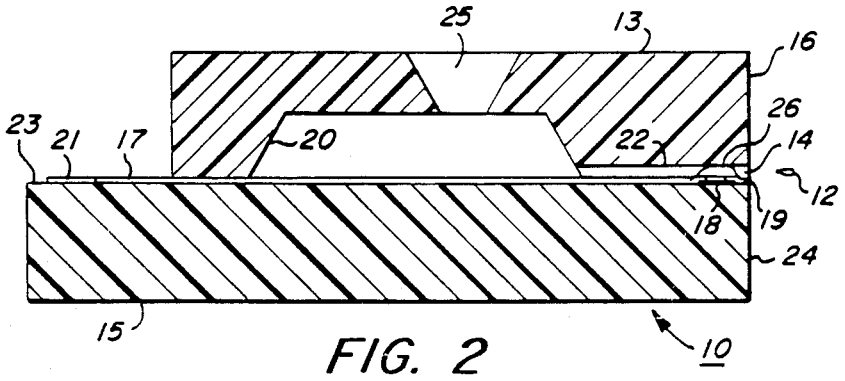
FIG. 2 is a partial view of the printhead as viewed along view line 2—2 of FIG. 1.

FIG. 2 is an enlarged cross-sectional view of the printhead as viewed along view line 2—2 of FIG. 1, showing the heating elements or resistors 18, individual addressing electrode 17 with terminal 21, and common return electrode 19. The resistors are patterned on the surface 23 of the heater plate 15, one for each ink channel in a manner described by the above-mentioned patent to Hawkins et al, and then the electrode 17 and common return electrode 19 are deposited thereon. The addressing electrodes and return electrode connected to respective terminals 21 near the edges of the heater plate, except for the edge 24 which is coplanar with the channel plate edge 16 containing the orifices 14 (see FIG. 1). The grounded common return 19, better seen in FIG. 1, necessarily spaces the heating element 18 from the heater plate edge 24 and thus the orifices 14. The addressing electrodes and heating elements are both within the ink channels, requiring pin hole free passivation wherever the ink may contact them. The terminals 21 are used for wire bonding (not shown) the addressing electrodes and common return to a voltage supply adapted to selectively address the heating elements with a current pulse representing digitized data, each pulse ejecting a droplet from the printhead and propelling it along trajectories 11 to a recording medium (not shown) by the formation, growth, and collapse of bubble 26. Opening 25 enables means for maintaining the manifold 20 full of ink.

As disclosed in U.S. Pat. No. 4,532,530 to Hawkins, the operating sequence of the bubble jet systems starts with a current pulse through the resistive heating element in the ink filled channel. In order for the printer to function properly, heat transferred from the heating element to the ink must be of sufficient magnitude to superheat the ink far above its normal boiling point. For water-based inks, the temperature for bubble nucleation is around 280° C. Once nucleated, the bubble or water vapor thermally isolates the ink from the heating element and no further heat can be applied to the ink. The bubble expands until all the heat stored in the ink in excess of the normal boiling point diffuses away or is used to convert liquid to vapor. The expansion of the bubble 26 forces a droplet 12 of ink out of the nozzle 14. Once the excess heat is removed, the bubble collapses on the heating element creating a severe cavitational stress which results in stress fracture over operating time. The heating element at this point is no longer being heated because the current pulse has passed and concurrently with the bubble collapse, the droplet is propelled at a high rate of speed in the direction towards a recording medium. The entire bubble formation/collapse sequence occurs in about 30 microseconds. The channel can be refired after 100–500 microseconds minimum dwell time to enable the channel to be refilled and to enable the dynamic refilling factors to become somewhat dampened.

A typical prior art heating element 18 with a vapor bubble 26 thereon shown in dashed line is schematically depicted in FIG. 3. The heater plate 15 may be insulative or semiconductive, such as silicon. If the heater plate is silicon, then an insulative layer 27 such as silicon dioxide or silicon nitride is formed on the surface 23 thereof prior to forming the resistive material 40 of the heating elements 18, addressing electrodes 17, and common return 19. Passivation layer 28 insulates the electrodes and common return from the ink, which is usually a water-based ink (not shown). Though any resistive material may be used, doped polysilicon is a popular material, and, if used, is generally insulated from a cavitation protecting layer 29, such as tantalum, by a thermally grown silicon dioxide layer 30. As seen, the bubble 26 (shown in dashed line) is adjacent the electrode interconnections with the resistive material, so that upon collapse the high velocity ink impacts not only the surface of the resistive material and its protective overlayers, but also delaminates the electrode 17 from the resistive layer 40 at the junction therebetween. The expulsion of a droplet of ink reduces the hydrodynamic impact on the downstream junction of common return 19 with the resistive material, so that the upstream junction of addressing electrode with the resistive material is the region most susceptible to attack by the cavitational stress resulting from a collapsing bubble.

An enlarged schematical cross-sectional view of the heating element 18 of FIG. 2 is shown in FIG. 4A. FIG. 4B is a top view of the resistive material 31 shown in FIG. 4A. Referring to FIGS. 4A and 4B, the upstream electrode-resistive material interface 36 is protected by a heating element structural arrangement which spaces the bubble generating and collapsing region 35 of the heating element 18 from the upstream electrode interface 36 by interposing a cooler less resistive portion 34 of the resistive material 31 therebetween. This is accomplished by narrowing the resistive material 31 to produce a high temperature section 33 when the bubble 26 shown in dashed line occurs. Not only is the section 34 of the resistive material 31 cooler by virtue of its larger width, but also because of its length which is longer than the downstream section 32. By virtue of the length of section 34 of resistive material 31, the electrode-resistive material interface 36 is spaced from the high temperature, bubble generating and collapsing region 35 produced by the narrow section 33 of the resistive material 31. Silicon dioxide or phosphosilicate glass mesas 39 can also be optionally constructed on the insulative layer 27 and under the bubble generating and collapsing area 35, so that only the narrow region 33 of the resistive material 31, such as doped polysilicon will get hot enough to nucleate vapor bubbles in the ink. The entire structure 31 between passivated electrodes 17, 19 is covered by thermal oxide layer 30 and overlaying tantalum protecting layer 29.

Figure 5:
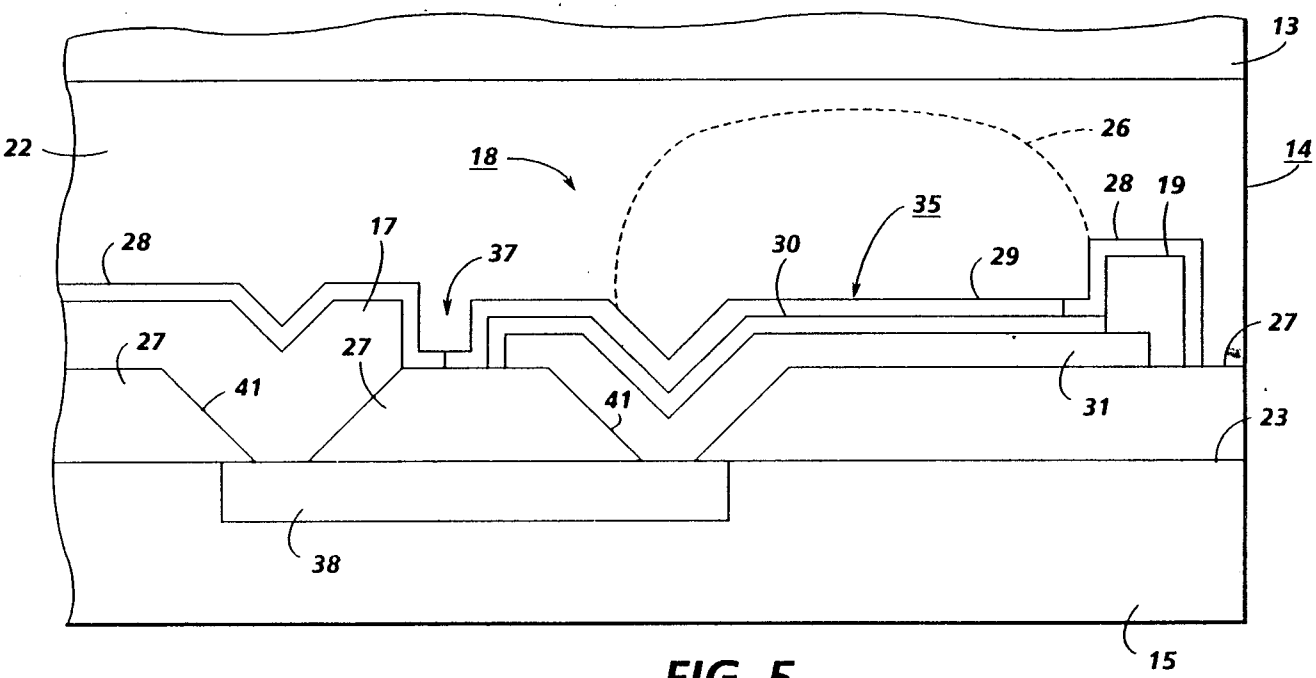
FIG. 5 is an enlarged, cross-sectional view of a second embodiment of the improved heating element shown in FIG. 2 and similar to the view in FIG. 4A.

FIG. 5 is an enlarged, schematical cross-sectional view of an alternate embodiment of a heating element 18 similar to that shown in FIG. 4A. The insulative layer 27, such as silicon dioxide or silicon nitride, is patterned to open vias 41 therein which permit access to buried conductive layer 38 of doped silicon in the surface 23 of silicon heater plate 15. The aluminum addressing electrode 17 contacts the buried conductive layer 38 at one end through one of the vias and the resistive material 31 contacts the other end of the buried layer through another via to produce a descender structure or cross over area 37 on the upstream side of the heating element 18 to space the bubble 26, shown in dashed line, and thus the high temperature, bubble generating and collapsing region 35, from the upstream interconnection of addressing electrode 17 with the resistive material of the heating element. The common return electrode 19 is connected to the resistive material 31 at the downstream end. The electrodes are passivated by an insulative layer 28, and the resistive material is passivated by a thermally grown silicon dioxide layer 30 when it is doped polysilicon as disclosed in U.S. Pat. No. 4,532,530 to Hawkins. Optionally, a cavitational resisting layer 29 such as tantalum may be used to cover the heating element resistive material's thermally grown silicon dioxide layer 30. The heating element structural arrangement of FIG. 5 is thermally efficient because of the use of the descender or cross-over construction which passes the bubble generating electrical pulse from the addressing electrode 17 to the resistive material 31 through the intermediate buried conductive layer 38 of doped silicon. The buried conductive layer could optionally serve as an area to construct a second common lead (not shown). In one configuration of the heating element structure of FIG. 5, the buried layer 38 has a resistance of 5 to 10 ohms per square, as opposed to the resistive material of doped polysilicon which has about 35 ohms per square.

Figure 6:
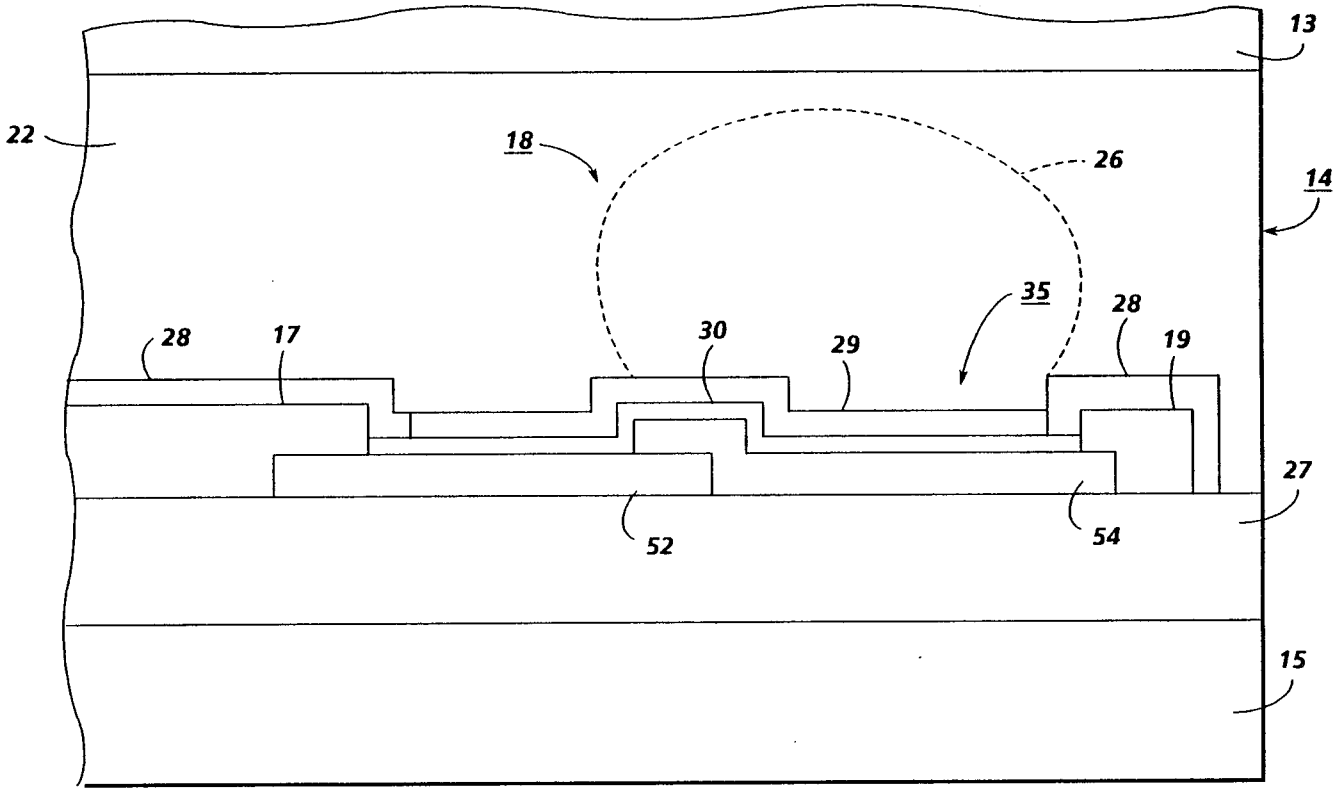
FIG. 6 is an enlarged, cross-sectional view of another embodiment of the improved heating element shown in FIG. 2 and similar to the views in FIG. 4A and 5.

In FIG. 6, another schematic embodiment of heating element 18 is shown in an enlarged, cross-sectional view, similar to that of FIGS. 4A and 5. In this embodiment, the resistive material of the heating element structure comprises two contiguous different regions or levels of doped polysilicon. One level of doped polysilicon 52 has a low sheet resistance of about 15 ohms per square, and the other level of doped polysilicon 54 has a high sheet resistance of about 35 ohms per square. The higher resistant resistive material 54 is downstream from the lower resistant resistive material 52 and is connected to the common return electrode 19 adjacent the nozzle 14. The addressing electrode 17 connects to the upstream end of the lower resistant resistive material, so that this level of resistive material functions to space the bubble generating and collapsing region from the electrode 17 which is most susceptible to cavitational stress damage. This is because the nozzle provides an outlet for the vector forces generated by the explosive bubble generation and collapse, while the laminated layers of aluminum addressing electrode 17 and passivating silicon dioxide layer 28 interface with the resistive material of the heating element must withstand the full brunt of the equal and oppositely directed vector forces. Thus, by providing a heating element structure which spaces the high temperature, bubble generating and collapsing region from the upstream electrode interface with the heating element's resistive material, the area of the heating element which tends to fail first is protected and the operating lifetime of the heating elements and hence the printhead is extended.

Many modifications and variations are apparent from the foregoing description of the invention and all such modifications and variations are intended to be within the scope of the present invention.

I claim:

1. An improved thermal ink jet printhead having a plurality of heating elements and metal addressing electrodes patterned on one surface of a substrate, the substrate being mated to a structure having ink flow directing channels with droplet emitting nozzles on one end thereof, each heating element being located in a respective one of the ink channels, upstream from the nozzles, the addressing electrodes connecting to each heating element on the upstream and downstream edges thereof, so that selective application of electrical signals to the heating elements eject and propel ink droplets from the nozzles to a recording medium, wherein the improvement comprises:

said heating elements having structures which provide a high temperature, bubble generating and collapsing section and a low temperature section, ink droplet expelling bubbles being produced on the high temperature section in response to the electrical signals applied to said heating elements and the low temperature section being concurrently incapable of producing bubbles, the high temperature, bubble generating section being located adjacent and connecting to the downstream electrode which is nearer the nozzle with the low temperature section being intermediate the high temperature section and the upstream electrode in order to space the high temperature section from the upstream metal addressing electrode interface area which is most susceptible to cavitational damage caused by the growth and collapse of the bubbles, thereby preventing damage to the upstream electrode interface area and increasing the heating element operating lifetime.

2. The improved printhead of claim 1, wherein each heating element comprises a resistive layer having a narrow portion adjacent the downstream electrode, which functions as the bubble generating, high temperature section, and a wider portion adjacent the upstream electrode, the length of the wider portion being longer than the narrow portion, so that the wider and longer portion functions as the low temperature section that is incapable of producing bubbles, thereby spacing the high temperature section from the upstream electrode interface which is most susceptible to cavitational damage.

3. The improved printhead of claim 2, wherein the substrate is silicon; and wherein the high temperature, bubble generating and collapsing area is thermally isolated from the substrate by silicon dioxide or phosphosilicate glass mesas.

4. The improved printhead of claim 1, wherein the substrate is silicon; and wherein each heating element comprises a resistive layer for the high temperature, bubble generating and collapsing section which is separated from the upstream addressing electrode interface area by a doped silicon descender arrangement that functions as the low temperature section, the descender arrangement comprising a buried conductive layer in the silicon substrate, so that the electrical signals pass from the upstream addressing electrode through the buried conductive layer to the high temperature resistive layer and then to the downstream electrode which serves as a return electrode.

5. The improved printhead of claim 1, wherein both the high temperature and low temperature sections of the heating element comprise a single resistive layer of doped polysilicon material, each section having a different sheet resistance, the section of higher resistivity being the bubble generating and collapsing section and the section of lower resistivity being the lower temperature section.

6. The improved printhead of claim 1, wherein the high temperature and low temperature sections comprise two separate, contiguous resistive layers of doped polysilicon material, each layer having a different sheet resistance, the layer of high resistivity being the bubble generating and collapsing section and the layer of lower resistivity being the lower temperature section.

* * * * *